US008525501B2

(12) United States Patent
Hsieh et al.

(10) Patent No.: US 8,525,501 B2
(45) Date of Patent: Sep. 3, 2013

(54) POWER FACTOR CORRECTION DEVICE SIMULTANEOUSLY APPLYING TWO TRIGGER SCHEMES

(75) Inventors: Chih-Yuan Hsieh, Hsinchu County (TW); Hsiang-Yi Chiu, Taipei County (TW)

(73) Assignee: NOVATEK Microelectrics Corp., Hsinchu Science Park, Hsin-Chu (TW)

( * ) Notice: Subject to any disclaimer, the term of this patent is extended or adjusted under 35 U.S.C. 154(b) by 321 days.

(21) Appl. No.: 12/987,999

(22) Filed: Jan. 10, 2011

(65) Prior Publication Data

US 2011/0170324 A1 Jul. 14, 2011

(30) Foreign Application Priority Data

Jan. 14, 2010 (TW) ..... 99100914 A

(51) Int. Cl.
*G05F 1/00* (2006.01)

(52) U.S. Cl.
USPC ..... 323/283; 323/286

(58) Field of Classification Search
USPC ..... 323/283, 286
See application file for complete search history.

(56) References Cited

U.S. PATENT DOCUMENTS

| | | | | |
|---|---|---|---|---|
| 5,818,707 | A | 10/1998 | Seong | |
| 7,567,134 | B2 | 7/2009 | Cohen | |
| 8,345,456 | B2 * | 1/2013 | Nishikawa | 363/89 |
| 2004/0263140 | A1 * | 12/2004 | Adragna et al. | 323/282 |
| 2007/0262823 | A1 | 11/2007 | Cohen | |
| 2009/0212756 | A1 * | 8/2009 | Shao et al. | 323/285 |
| 2010/0110593 | A1 * | 5/2010 | Kim et al. | 361/18 |

FOREIGN PATENT DOCUMENTS

| | | |
|---|---|---|
| CN | 1191738 C | 3/2005 |
| KR | 100446275 | 11/2004 |
| TW | 200620792 | 6/2006 |
| TW | 200728953 | 8/2007 |

* cited by examiner

*Primary Examiner* — Adolf Berhane
*Assistant Examiner* — Emily Pham
(74) *Attorney, Agent, or Firm* — Winston Hsu; Scott Margo

(57) ABSTRACT

A power factor correction device includes a rectifier for converting an AC input voltage into a DC input voltage, an output module for generating and outputting a DC output voltage, an intermediate inductor coupled between the rectifier and the output module, a power switch for controlling an inductor current of the intermediate inductor and generating a source voltage, a reset module for generating a reset instruction according to the DC input voltage, the DC output voltage and the source voltage, an SR flip-flop for outputting a latch result according to a set instruction and the reset instruction, and a set module for generating the set instruction in response to variation of the intermediate inductor or variation of the latch result.

34 Claims, 10 Drawing Sheets

POWER FACTOR CORRECTION DEVICE SIMULTANEOUSLY APPLYING TWO TRIGGER SCHEMES

BACKGROUND OF THE INVENTION

1. Field of the Invention

The present invention is related to a power factor correction device, and more particularly, to a power factor correction device enhancing a power factor and reducing a conduction loss by simultaneously applying two "set" trigger schemes of an SR flip-flop.

2. Description of the Prior Art

A power factor is a ratio of an effective power to a total dissipated power, and is utilized for estimating electrical power efficiency. In general, the greater the power factor, the better the electrical power efficiency. Therefore, a power supply usually includes a power factor correction device to ensure that waveforms of an alternating current (AC) and an AC voltage are consistent and suppress undesired harmonics, so as to enhance power efficiency. Most power factor correction devices can be divided into two categories: passive type and active type. A passive power factor correction device is composed of passive components, such as inductors, capacitors, etc., and is designed for processing a low frequency (50-60 Hz) AC input with at most a 75-80% power factor. On the contrary, an active power factor correction device is composed of active components, such as power transistors, and is utilized for regulating a waveform of an input current to be consistent with a waveform of an input voltage. In theory, the active power factor correction device can achieve almost a 100% power factor. For that reason, most power supplies employ the active power correction device, especially in high-power applications.

Please refer to FIG. 1A, which is a schematic diagram of an active power factor correction device 10 of the prior art. The power factor correction device 10 mainly includes a diode bridge rectifier 100, an intermediate inductor 110, a power transistor 112, a set/reset (SR) flip-flop 114, a sensing inductor 116, a multiplier 118, an error amplifier 120, a comparator 122 and dividing circuits 130, 140. The diode bridge rectifier 100 is utilized for converting an AC input voltage $VIN_{AC}$ into a direct current (DC) input voltage $VIN_{DC}$. Combination of the intermediate inductor 110 and the sensing inductor 116 functions as a voltage transformer for setting a latch result LAT of the SR flip-flop 114 to "1" when an inductor current $I_L$ of the intermediate inductor 110 decays to zero to enable the power transistor 112. Once the power transistor 112 is enabled, the inductor current $I_L$ increases, causing a source voltage VS of the power transistor 112 to rise. In addition, the dividing circuits 130, 140 are respectively utilized for generating a divided voltage Vdiv1 of the DC input voltage $VIN_{DC}$ and a divided voltage Vdiv2 of a DC output voltage $VOUT_{DC}$. The error amplifier 120 compares the divided voltage Vdiv2 with a reference voltage VREF to generate a comparison result COMP. Next, the multiplier 118 multiplies the divided voltage Vdiv1 by the comparison result COMP to generate a voltage product MUL. Finally, the comparator 122 compares the voltage product MUL with the source voltage VS to determine whether to reset the latch result LAT of the SR flip-flop 114 to "0" accordingly. When the source voltage VS is greater than the voltage product MUL, the latch result LAT is "0", and the power transistor 112 is disabled to reduce the inductor current $I_L$. Such a control mode is called a "Boundary Mode (BM)".

In short, by periodically setting and resetting the latch result LAT, the waveform of the average current $I_{L_avg}$ of the inductor current $I_L$ can follow the waveform of the DC input voltage $VIN_{DC}$, as illustrated in FIG. 1B. Despite the excellent power factor shown in FIG. 1B, a root mean square (RMS) value of the inductor current $I_L$ is extraordinarily high, and therefore it is disadvantageous to employ the power factor correction device 10 in applications with serious conduction loss.

Please continue to refer to FIG. 2A, which is a schematic diagram of another active power factor correction device 20 of the prior art. The power factor correction device 20 is an enhanced version of the power factor correction device 10, and differs only in a timer 200 replacing the sensing inductor 116 shown in FIG. 1A. The timer 200 is utilized for clocking, since the latch result LAT is reset (LAT:1→0), and triggering the SR flip-flop 114 to set the latch result LAT to "1" after a default period. As a result, a waveform of the average current $I_{L_avg}$ of the inductor current $I_L$ can follow a waveform of the DC input voltage $VIN_{DC}$, as illustrated in FIG. 2B. Such a control mode is called "Fixed Off-Time (FOT) control".

Compared to the power factor correction device 10, the power factor correction device 20 benefits from a lower RMS value of the inductor current $I_L$, i.e. lower conduction loss. However, since the power transistor 112 is disabled during the default period, which is fixed, the power factor correction device 20 enters a discontinuous conduction mode (DCM) from a continuous conduction mode (CCM) when the average current $I_{L_avg}$ of the inductor current $I_L$ approaches zero, causing distortion in the average current $I_{L_avg}$ and decay in the power factor. That is, neither of the power factor correction devices 10, 20 can simultaneously benefit from "high power factor" and "low conduction loss".

Therefore, enhancing the power factor correction device to achieve both "high power factor" and "low conduction loss" has been a major focus of the industry.

SUMMARY OF THE INVENTION

It is therefore a primary objective of the claimed invention to provide a power factor correction device.

The present invention discloses a power factor correction device, which comprises a rectifier for converting an alternating current (AC) input voltage into a direct current (DC) input voltage, an output module for generating and outputting a DC output voltage, an intermediate inductor, coupled between the rectifier and the output module, a power switch comprising a first end coupled between the intermediate inductor and the output module, a second end coupled to a resistor, and a third end, for determining whether the first end is electrically connected to the second end according to signals received by the third end, a reset module comprising a first input end coupled between the rectifier and the intermediate inductor, a second input end coupled to the output module, and a third input end coupled to the second end of the power switch, for generating a reset instruction according to the DC input voltage, the DC output voltage and a voltage of the second end of the power switch, a set/reset (SR) flip-flop comprising a set end, a reset end coupled to the reset module, and an output end coupled to the third end of the power switch, for outputting a latch result from the output end according to signals received by the set end and the reset end, and a set module for generating a set instruction sent to the set end of the SR flip-flop according to variation of an inductor current of the intermediate inductor or variation of the latch result.

These and other objectives of the present invention will no doubt become obvious to those of ordinary skill in the art after reading the following detailed description of the preferred embodiment that is illustrated in the various figures and drawings.

DETAILED DESCRIPTION

Figure 3A:
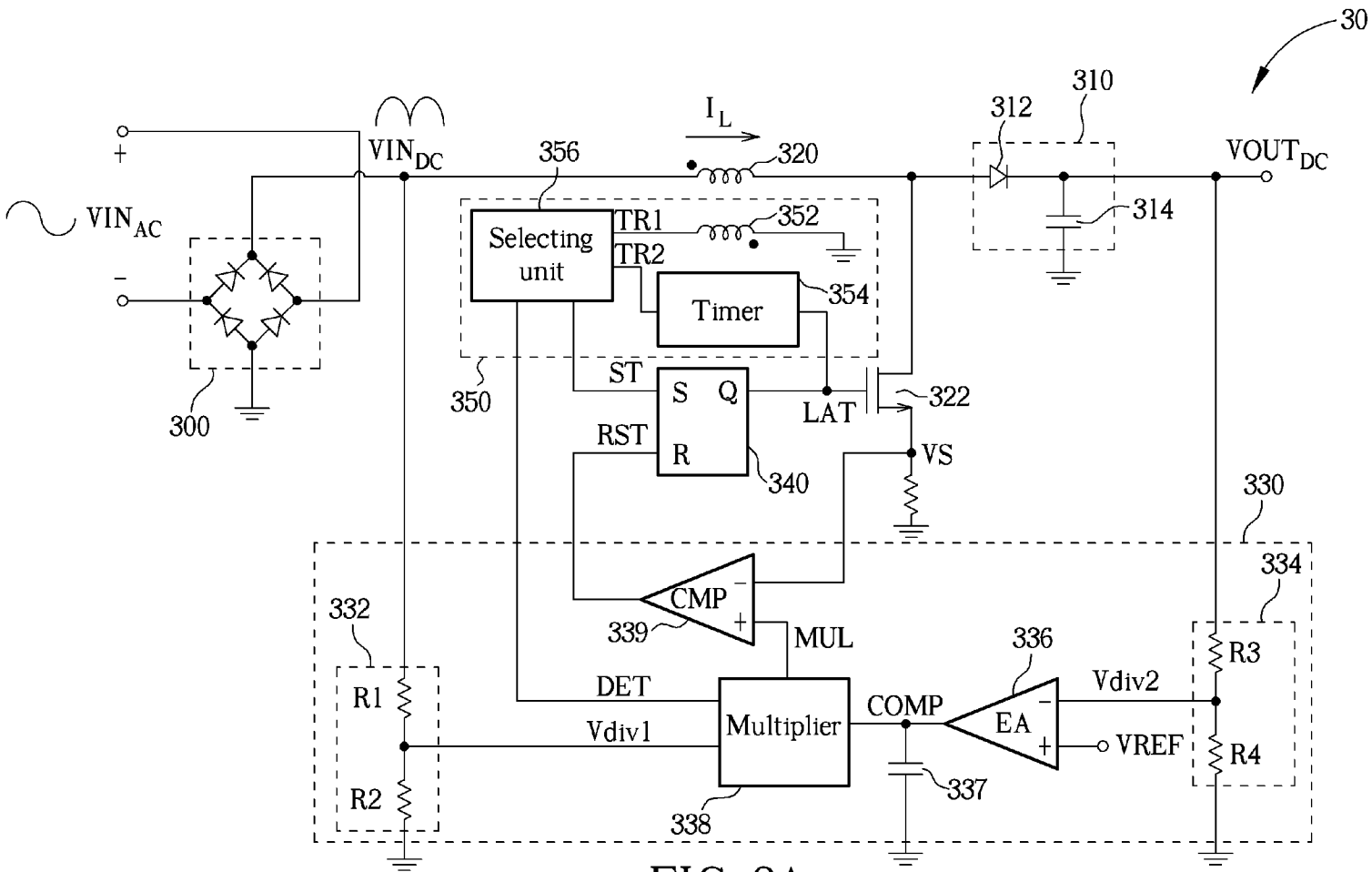
FIG. 3A is a schematic diagram of a power factor correction device according to an embodiment of the present invention.

Please refer to FIG. 3A, which is a schematic diagram of a power factor correction device 30 according to an embodiment of the present invention. The power factor correction device 30 includes a rectifier 300, an output module 310, an intermediate inductor 320, a power switch 322, a reset module 330, a set/reset (SR) flip-flop 340 and a set module 350. The rectifier 300 is utilized for converting an alternating current (AC) input voltage $VIN_{AC}$ into a direct current (DC) input voltage $VIN_{DC}$. The output module 310 is utilized for generating and outputting a DC output voltage $VOUT_{DC}$. The power switch 322, preferably a metal oxide semiconductor (MOS) transistor, is coupled to a source resistor RS for determining whether a source end and a drain end thereof are electrically connected based upon a latch result LAT received by a gate end thereof, and generating a source voltage VS. The reset module 330 is utilized for generating a reset instruction RST according to the DC input voltage $VIN_{DC}$, the DC output voltage $VOUT_{DC}$ and the source voltage VS. The SR flip-flop 340 is utilized for outputting the latch result LAT according to a set instruction ST and the reset instruction RST generated by the reset module 330. The set module 350 is utilized for generating the set instruction ST sent to the SR flip-flop 340 according to variation of an inductor current $I_L$ of the intermediate inductor 320 or variation of the latch result LAT.

In short, the power factor correction devices 10, 20 of the prior art are integrated into the power factor correction device 30 to simultaneously apply "set" trigger schemes of the SR flip-flops of the power factor correction devices 10, 20. As a result, the power factor correction device 30 can alternatively operate in a fixed off-time (FOT) control mode or a boundary mode (BM). In other words, to minimize a conduction loss, the power factor correction device 30 mainly operates in the FOT control mode, but switches to the BM when the inductor current $I_L$ approaches zero to prevent wave distortion from appearing in an average current $I_{L_avg}$ of the inductor current $I_L$, since the power factor correction device 30 correspondingly enters a discontinuous conduction mode (DCM) from a continuous conduction mode (CCM).

In detail, the set module 350 includes a sensing inductor 352, a timer 354 and a selecting unit 356. Similar to the sensing inductor 116 of the power factor correction device 10, the sensing inductor 352 is utilized for sensing variation of the inductor current $I_L$ of the intermediate inductor 320 to generate a first trigger instruction TR1. Meanwhile, the timer 352 is utilized for generating a second trigger instruction TR2 according to variation of the latch result LAT just as the timer 200 of the power factor correction device 20 functions. Finally, the selecting unit 356 generates the set instruction ST sent to the SR flip-flop 340 according to the first trigger instruction TR1 or the second trigger instruction TR2 to set the latch result LAT to "1".

Via the selecting unit 356, the power factor correction device 30 simultaneously applies "set" trigger schemes of the SR flip-flops of the power factor correction devices 10, 20. That is, the sensing inductor 352 generates the first trigger instruction TR1 by demagnetization when the inductor current $I_L$ decays to zero. Meanwhile, the timer 354 starts to clock when the inductor current $I_L$ transitions from rising to falling, and then generates the second trigger instruction TR2 after a default period.

Since both of the "set" trigger schemes of the power factor correction devices 10, 20 are employed in the power factor correction device 30, the selecting unit 356 preferably can be an OR gate for performing a logic OR operation on the first trigger instruction TR1 and the second trigger instruction TR2 to generate the set instruction ST.

In addition, the reset module 330 includes a first dividing circuit 332, a second dividing circuit 334, an error amplifier 336, a multiplier 338 and a comparator 339. The first dividing circuit 332 is utilized for dividing the DC input voltage $VIN_{DC}$ to generate a first divided voltage Vdiv1. Similarly, the second dividing circuit 334 divides the DC output voltage $VOUT_{DC}$ to generate a second divided voltage Vdiv2. The error amplifier 336 is utilized for comparing the second divided voltage Vdiv2 with a reference voltage VREF to generate a comparison result COMP. Next, the multiplier 338 multiplies the comparison result COMP by the first divided voltage Vdiv1 to generate a voltage product MUL. Finally, the comparator 338 compares the voltage product MUL by the source voltage VS to generate the reset instruction RST.

Figure 1A:
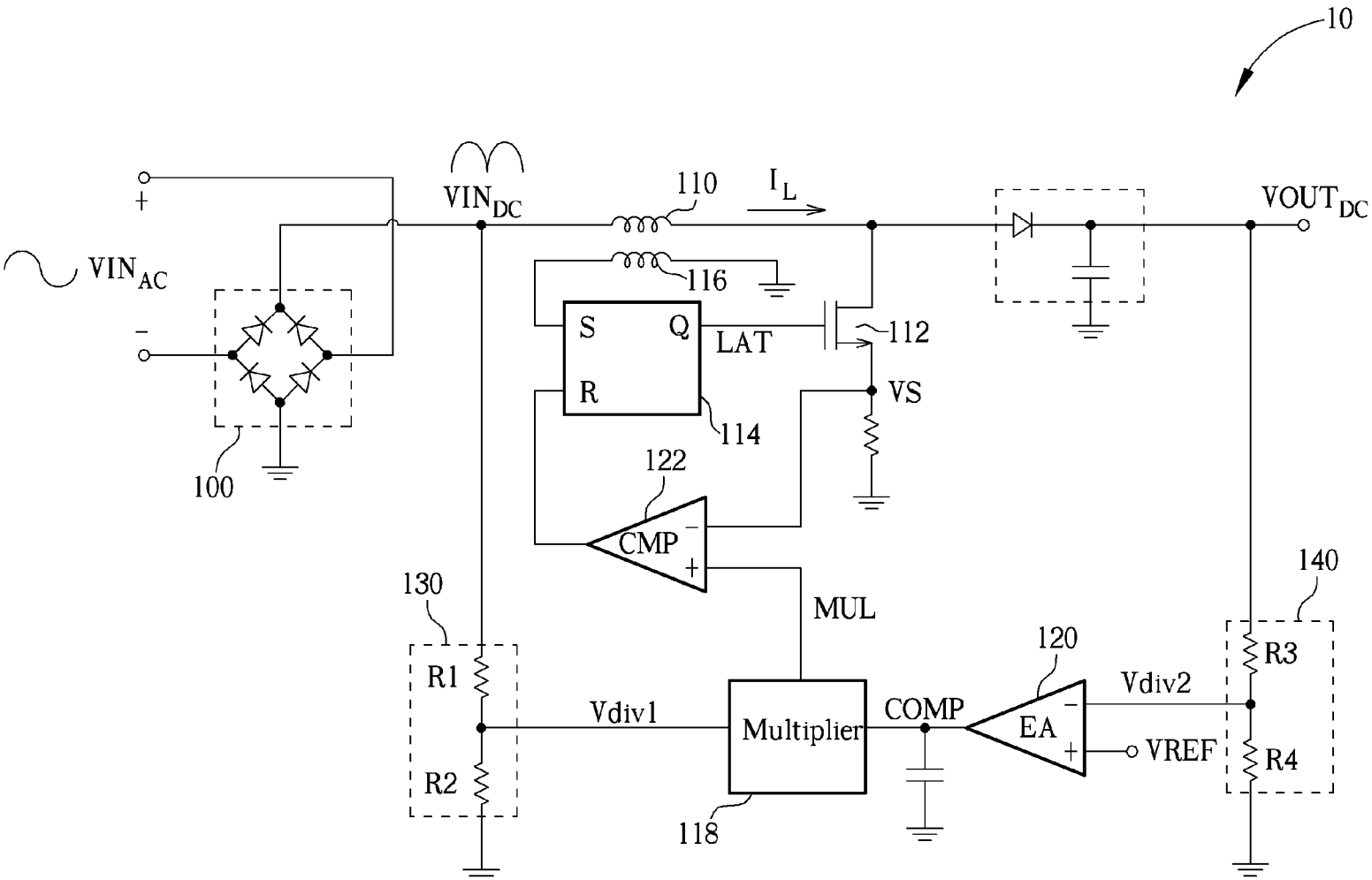
FIG. 1A PRIOR ART
FIG. 1A is a schematic diagram of an active power factor correction device of the prior art.
Figure 1B:
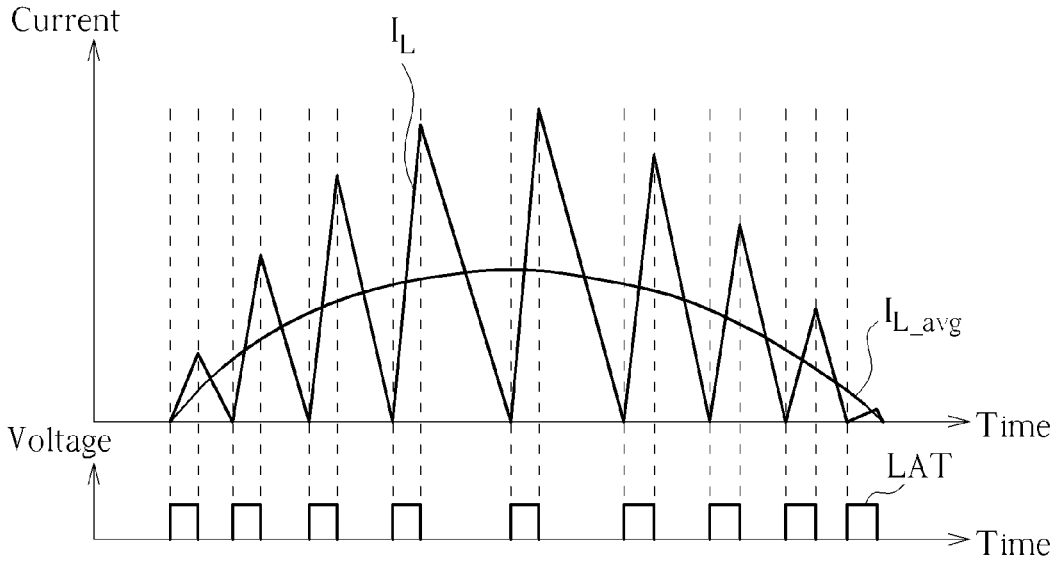
FIG. 1B PRIOR ART
FIG. 1B is a time-variant schematic diagram of an inductor current and a latch result of the power factor correction device shown in FIG. 1A.
Figure 2A:
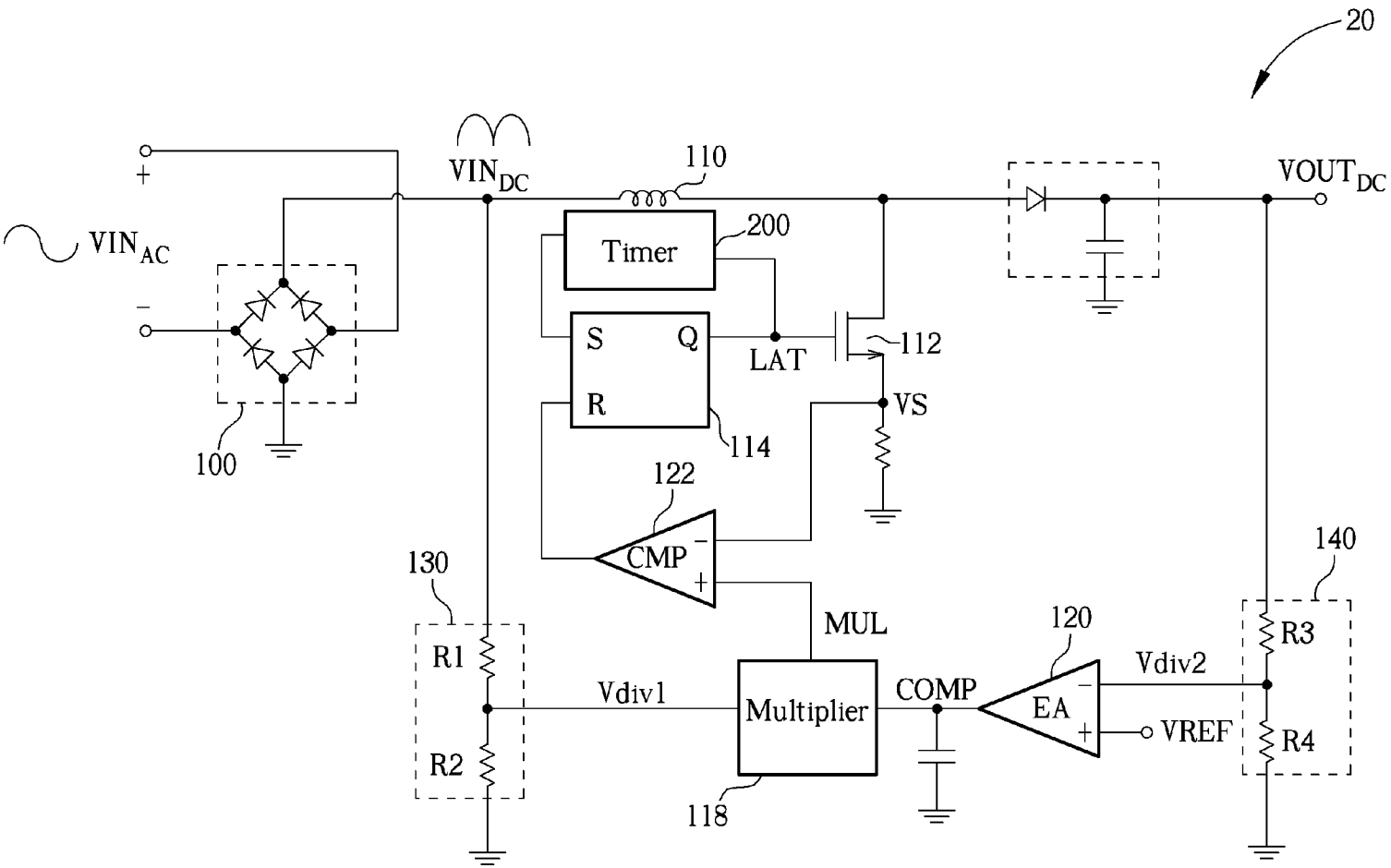
FIG. 2A PRIOR ART
FIG. 2A is a schematic diagram of another active power factor correction device of the prior art.
Figure 2B:
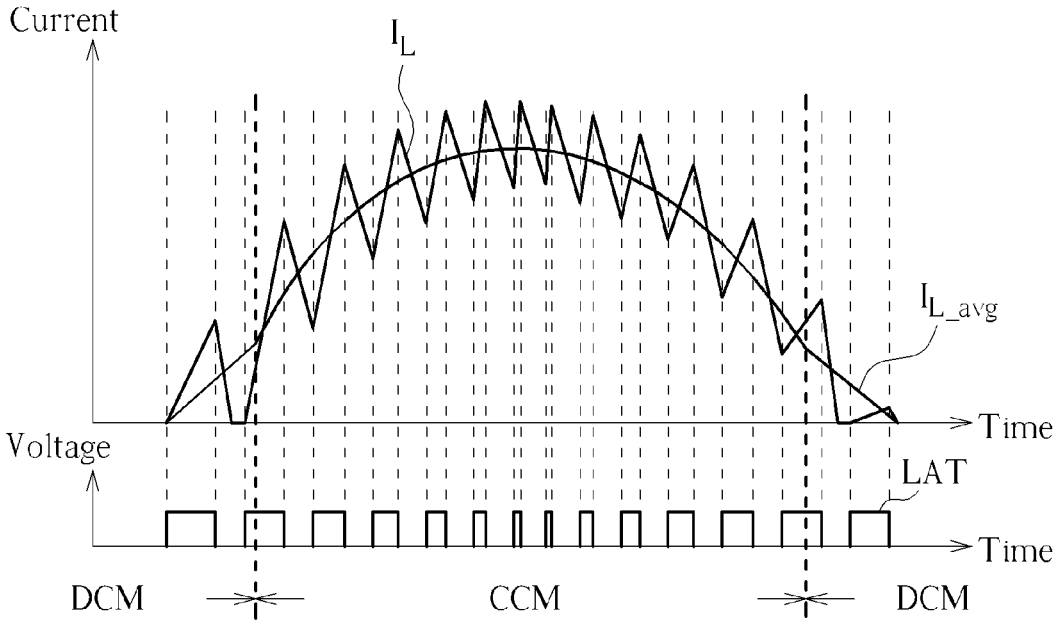
FIG. 2B PRIOR ART
FIG. 2B is a time-variant schematic diagram of an inductor current and a latch result of the power factor correction device shown in FIG. 2A.
Figure 3B:
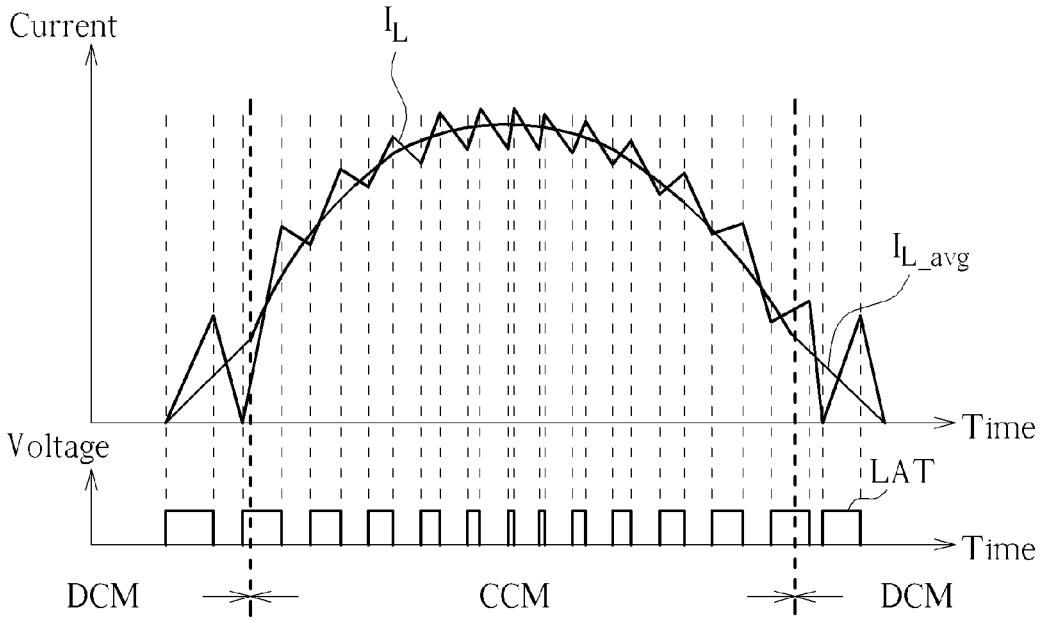
FIG. 3B is a time-variant schematic diagram of an inductor current and a latch result of the power factor correction device shown in FIG. 3A.

Note that the average current $I_{L_avg}$ of the inductor current $I_L$ of the power factor correction device 10 is merely half of the average current $I_{L_avg}$ of the inductor current $I_L$ of the power factor correction device 20, as illustrated in FIG. 1B and FIG. 2B. In other words, under the architecture combining the power factor correction devices 10, 20, an average current $I_{L_avg}$ of the inductor current $I_L$ of the power factor correction device 30 decays by half when the power factor correction device 30 transitions from the FOT control mode to the BM, as illustrated in FIG. 3B. In order to recover the distorted average current $I_{L_avg}$, preferably, the selecting unit 356 can further be coupled to the reset module 330 to determine whether the power factor correction device 30 operates in the FOT control mode or the BM based upon the first trigger instruction TR1 or the second trigger instruction TR2, to generate a detection result DET sent to the reset module 330, as illustrated in FIG. 3A. Correspondingly, the multiplier 338 is further utilized for compensating a gain according to the detection result DET, so as to ensure the average current $I_{L_avg}$ remains a full-wave rectified sine wave when the power factor correction device 30 switches the operation mode.

Figure 3C:
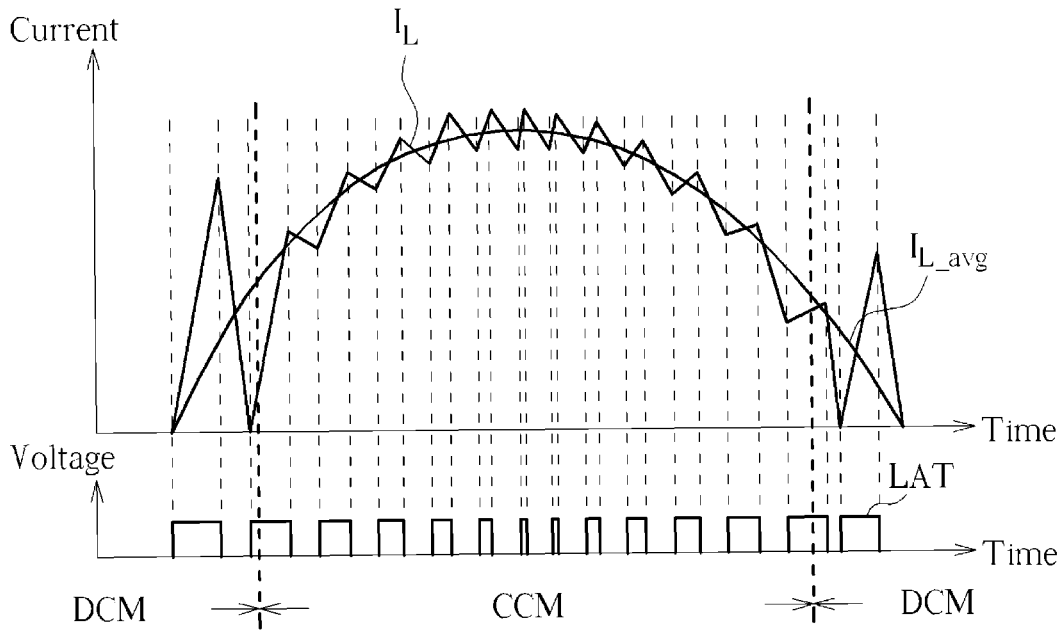
FIG. 3C is a time-variant diagram of the inductor current and the latch result shown in FIG. 3B after being compensated.

For example, the multiplier 338 can switch the gain to a double gain when the detection result DET indicates that the set instruction ST is triggered by the first trigger instruction TR1, and switch the gain to a unit gain when the detection result DET indicates that the set instruction ST is triggered by the second trigger instruction TR2. As a result, the average current $I_{L_avg}$ can remain the full-wave rectified sine wave, as illustrated in FIG. 3C.

Figure 4:
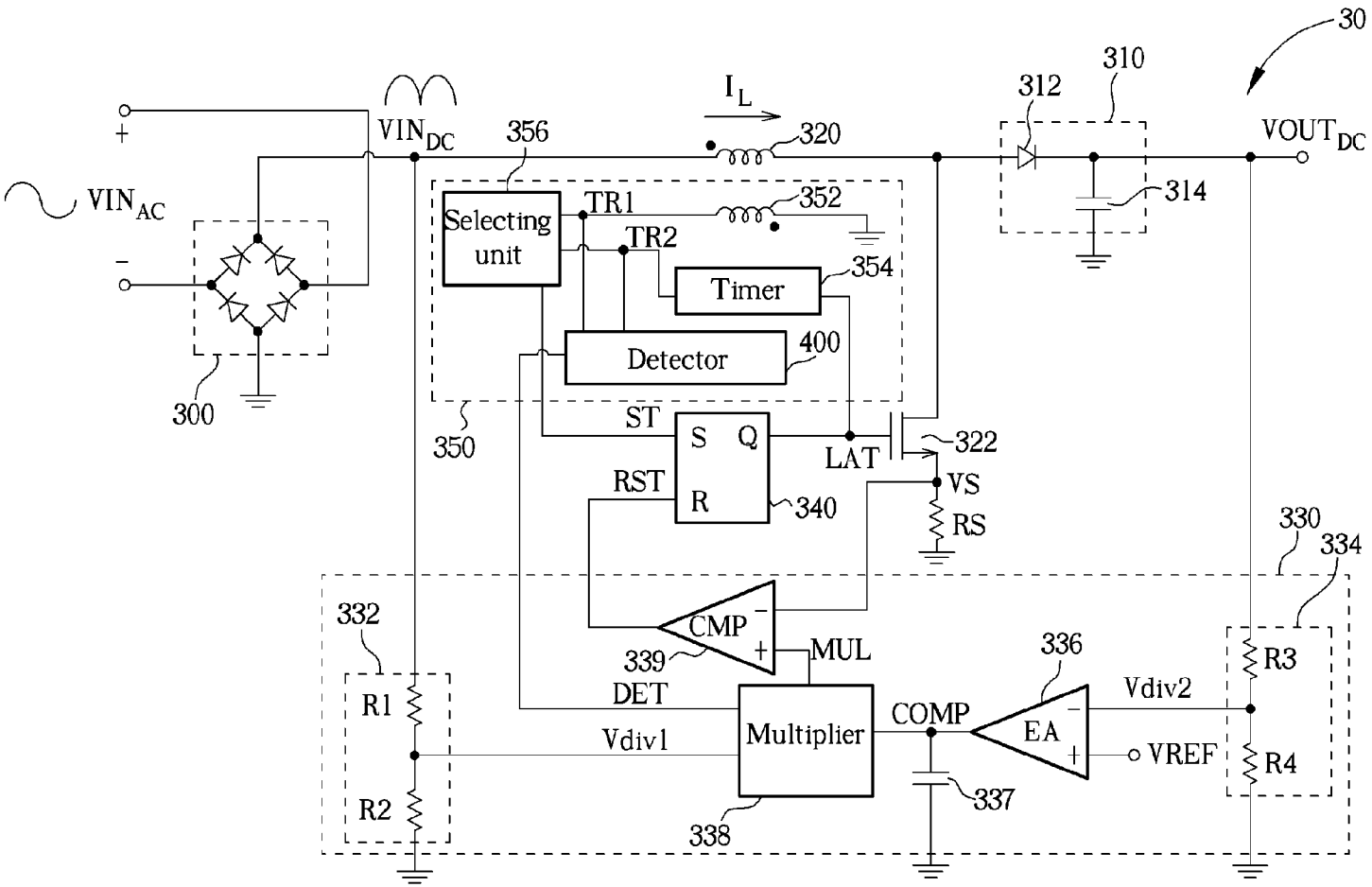
FIG. 4 is a schematic diagram of an alternative embodiment of the power factor correction device shown in FIG. 3A.

Certainly, those skilled in the art can generate the detection result DET by other methods in response to specific requirements. For example, a detector 400 can further be included in the set module 350, as illustrated in FIG. 4. The detector 400 is utilized for determining the operation mode of the power factor correction device 30 according to the first trigger instruction TR1 and the second trigger instruction TR2 to generate the detection result DET sent to the multiplier 338.

Figure 5A:
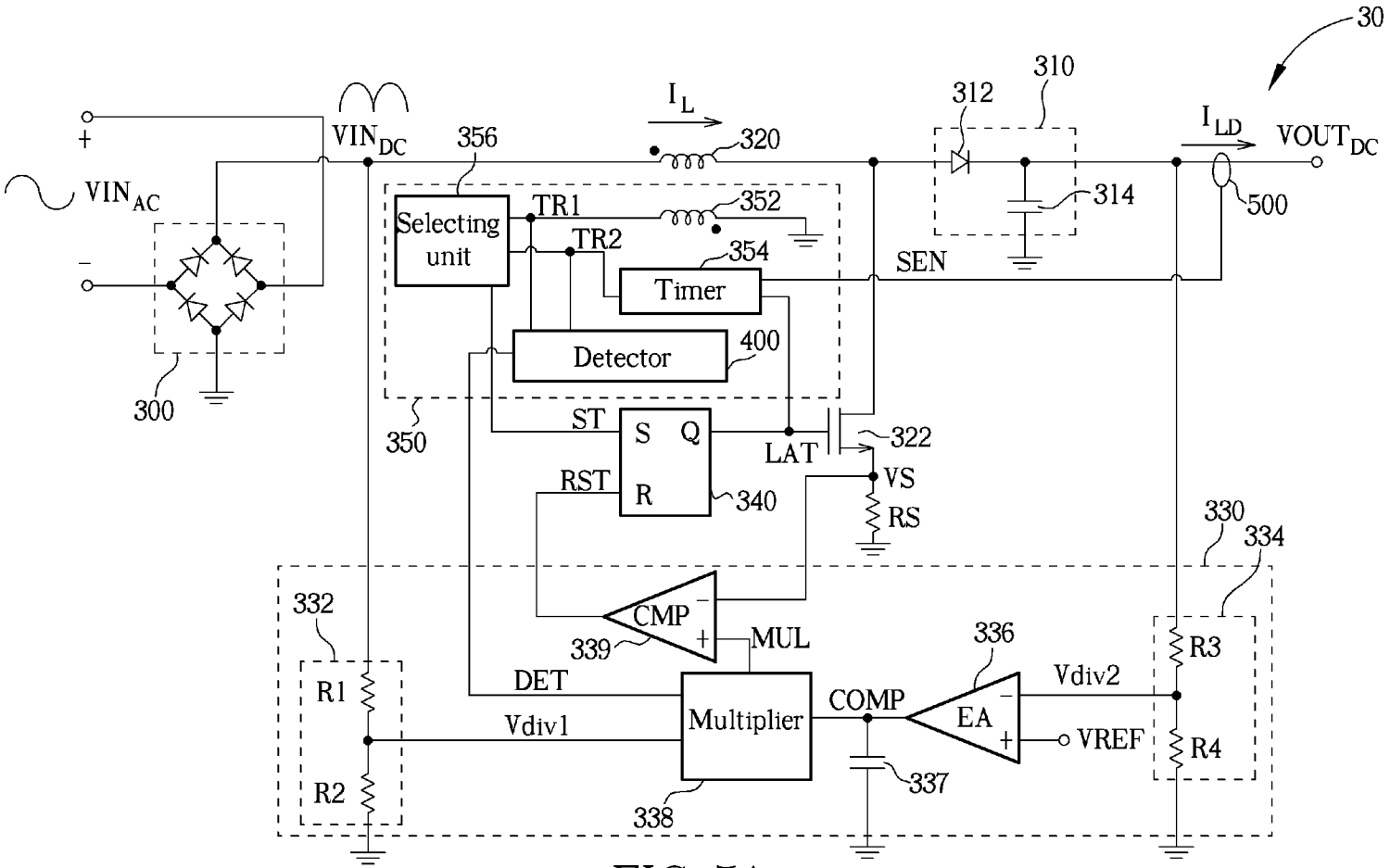
FIG. 5A is a schematic diagram of another alternative embodiment of the power factor correction device shown in FIG. 3A.
Figure 5B:
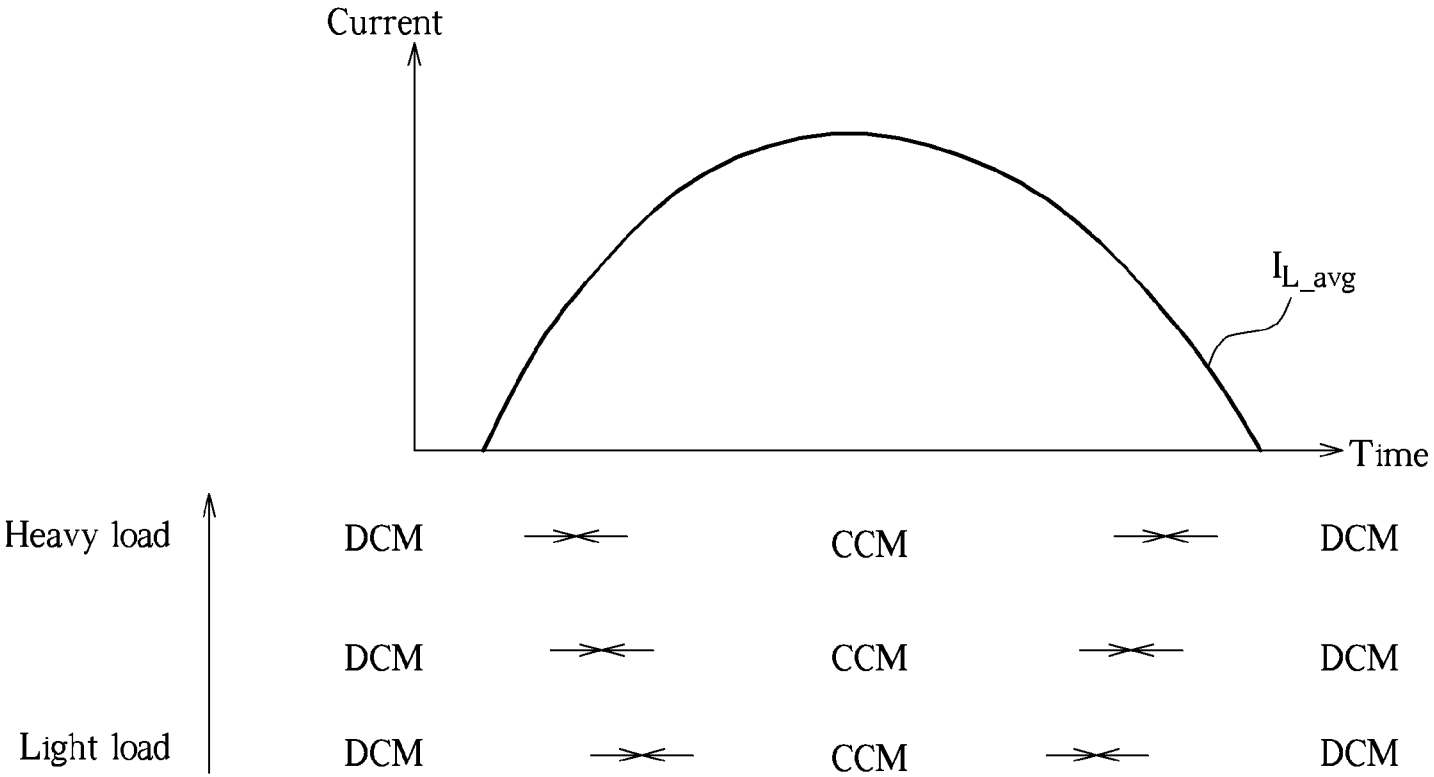
FIG. 5B is a schematic diagram of mode transitions of the power factor correction device shown in FIG. 5A.

In addition, since a switching loss is the major cause of energy loss when the power factor correction device 30 operates in a light load state, and so is a conduction loss in a heavy load state, the present invention further adjusts a ratio of a period in which the power factor correction device 30 operates in the CCM to a period in which the power factor correction device 30 operates in the DCM (CCM/DCM). To do so, the power factor correction device 20 further includes a load sensor 500, as illustrated in FIG. 5A. The load sensor 500 is utilized for sensing a load current $I_{LD}$ of the power factor correction device 30 to generate a sensing result SEN sent to the timer 354. Correspondingly, the timer 354 shortens the default period when the sensing result SEN indicates that the load current ILD is heavy to reduce the conduction loss. Inversely, the timer 354 extends the default period when the sensing result SEN indicates that the load current $I_{LD}$ is light to reduce the switching loss. In other words, the power factor correction device 30 reduces percentage of the BM when the load current $I_{LD}$ is heavy to reduce the conduction loss, and reduces percentage of the FOT control mode when the load current $I_{LD}$ is light to reduce the switching loss, as illustrated in FIG. 5B.

For more details, the reset module 330 further includes a compensation capacitor 337 for compensating closed-loop frequency response of the power factor correction device 30 and filtering the comparison result COMP. The output module 310 includes a diode 312 and an output capacitor 314 to generate the DC output voltage $VOUT_{DC}$. Preferably, the rectifier 300 is a diode bridge rectifier.

In the prior art, the power factor correction device 10 benefits from high power factor but suffers from high conduction loss. Inversely, the power factor correction device 20 benefits from low conduction loss but suffers from the distorted inductor current $I_L$ (low power factor). In other words, each of the power factor correction devices 10, 20 cannot simultaneously benefit from high power factor and low conduction loss. In comparison, the present invention simultaneously employs the "set" trigger schemes of the SR flip-flops of the power factor correction devices 10, 20 in the power factor correction device 30 to benefit both from high power factor and low conduction loss. That is, to reduce the conduction loss, the power factor correction device 30 mainly operates in the FOT control mode, and switches to the BM to prevent the average current $I_{L_avg}$ from distortion. Moreover, the present invention adjusts the ratio (CCM/DCM) based upon variation of the load current $I_{LD}$, so as to minimize a summation of the conduction loss and the switching loss.

To sum up, the present invention simultaneously employs the "set" trigger schemes of the SR flip-flop respectively corresponding to the FOT control mode and the BM, such that the power factor correction device can benefit both from high power factor and low conduction loss.

Those skilled in the art will readily observe that numerous modifications and alterations of the device and method may be made while retaining the teachings of the invention.

What is claimed is:

1. A power factor correction device comprising:

a rectifier, for converting an alternating current (AC) input voltage into a direct current (DC) input voltage;

an output module, for generating and outputting a DC output voltage;

an intermediate inductor, coupled between the rectifier and the output module;

a power switch, comprising a first end coupled between the intermediate inductor and the output module, a second end coupled to a resistor, and a third end, for determining whether the first end is electrically connected to the second end according to signals received by the third end;

a reset module, comprising a first input end coupled between the rectifier and the intermediate inductor, a second input end coupled to the output module, and a third input end coupled to the second end of the power switch, for generating a reset instruction according to the DC input voltage, the DC output voltage and a voltage of the second end of the power switch;

a set/reset (SR) flip-flop, comprising a set end, a reset end coupled to the reset module, and an output end coupled to the third end of the power switch, for outputting a latch result from the output end according to signals received by the set end and the reset end; and a set module, for generating a set instruction sent to the set end of the SR flip-flop according to variation of an inductor current of the intermediate inductor or variation of the latch result;

wherein the set module comprises:

a sensing inductor, coupled to a ground end, for sensing variation of the inductor current of the intermediate inductor to generate a first trigger instruction;

a timer, coupled to the third end of the power switch and the output end of the SR flip-flop, for generating a second trigger instruction according to variation of the latch result; and a selecting unit, coupled to the sensing inductor, the timer and the set end of the SR flip-flop, for generating the set instruction sent to the set end of the SR flip-flop according to the first trigger instruction or the second trigger instruction.

2. The power factor correction device of claim 1, wherein the selecting unit is an OR gate for performing a logic OR operation on the first trigger instruction and the second trigger instruction to generate the set instruction.

3. The power factor correction device of claim 1, wherein the sensing inductor generates the first trigger instruction by demagnetization when the inductor current of the intermediate inductor decays to zero.

4. The power factor correction device of claim 1, wherein the timer starts to clock when the inductor current of the intermediate inductor transitions from rising to falling, and then generates the second trigger instruction after a default period.

5. The power factor correction device of claim 4 further comprising a load sensor, coupled to the output module, the set module and the reset module, for sensing a load current of the power factor correction device to generate a sensing result sent to the timer.

6. The power factor correction device of claim 5, wherein the timer shortens the default period when the sensing result indicates that the load current is heavy to reduce a conduction loss of the power factor correction device.

7. The power factor correction device of claim 5, wherein the timer extends the default period when the sensing result indicates that the load current is light to reduce a switching loss of the power factor correction device.

8. The power factor correction device of claim 1, wherein the output module comprises:

a diode, comprising an anode end coupled to the intermediate inductor and the power switch and a cathode end coupled to the reset module; and an output capacitor, comprising one end coupled to the cathode end of the diode and the reset module and another end coupled to a ground end, for generating the DC output voltage.

9. The power factor correction device of claim 1, wherein the selecting unit is further coupled to the reset module for determining an operation mode of the power factor correction device according to the first trigger instruction or the second trigger instruction to generate a detection result sent to the reset module.

10. The power factor correction device of claim 1, wherein the reset module comprises:

a first dividing circuit, coupled to the rectifier and the intermediate inductor, for dividing the DC input voltage to generate a first divided voltage;

a second dividing circuit, coupled to the output module, for dividing the DC output voltage to generate a second divided voltage;

an error amplifier, coupled to the second dividing circuit, for comparing the second divided voltage and a reference voltage to generate a comparison result;

a multiplier, coupled to the first dividing circuit and the error amplifier, for multiplying the comparison result by the first divided voltage to generate a voltage product; and a comparator, coupled to the power switch, the multiplier and the SR flip-flop, for comparing the voltage product and a voltage of the second end of the power switch to generate the reset instruction.

11. The power factor correction device of claim 10 further comprising:

a detector for determining an operation mode of the power factor correction device according to the first trigger instruction and the second trigger instruction to generate a detection result sent to the multiplier of the reset module;

wherein the multiplier is further utilized for compensating a gain according to the detection result to ensure an average of the inductor current remains a full-wave rectified sine wave when the power factor correction device switches the operation mode.

12. The power factor correction device of claim 11, wherein the multiplier switches the gain to a double gain when the detection result indicates that the set instruction is triggered by the first trigger instruction.

13. The power factor correction device of claim 11, wherein the multiplier switches the gain to a unit gain when the detection result indicates that the set instruction is triggered by the second trigger instruction.

14. The power factor correction device of claim 11, wherein the detector is integrated into the set module.

15. The power factor correction device of claim 10, wherein the reset module further comprises a compensation capacitor, comprising one end coupled between the error amplifier and the multiplier and another end coupled to the ground end, for compensating closed-loop frequency response of the power factor correction device and filtering the comparison result.

16. The power factor correction device of claim 1, wherein the power switch is a metal oxide semiconductor (MOS) transistor, the first end is a drain, the second end is a source, and the third end is a gate.

17. The power factor correction device of claim 1, wherein the rectifier is a diode bridge rectifier.

18. A power factor correction device comprising:

a rectifier, for converting an alternating current (AC) input voltage into a direct current (DC) input voltage;

an output module, for generating and outputting a DC output voltage;

an intermediate inductor, coupled between the rectifier and the output module;

a power switch, comprising a first end coupled between the intermediate inductor and the output module, a second end coupled to a resistor, and a third end, for determining whether the first end is electrically connected to the second end according to signals received by the third end;

a reset module, comprising a first input end coupled between the rectifier and the intermediate inductor, a second input end coupled to the output module, and a third input end coupled to the second end of the power switch, for generating a reset instruction according to the DC input voltage, the DC output voltage and a voltage of the second end of the power switch;

a set/reset (SR) flip-flop, comprising a set end, a reset end coupled to the reset module, and an output end coupled to the third end of the power switch, for outputting a latch result from the output end according to signals received by the set end and the reset end; and a set module, for generating a set instruction sent to the set end of the SR flip-flop according to variation of an inductor current of the intermediate inductor or variation of the latch result;

wherein the reset module comprises:

a first dividing circuit, coupled to the rectifier and the intermediate inductor, for dividing the DC input voltage to generate a first divided voltage;

a second dividing circuit, coupled to the output module, for dividing the DC output voltage to generate a second divided voltage;

an error amplifier, coupled to the second dividing circuit, for comparing the second divided voltage and a reference voltage to generate a comparison result;

a multiplier, coupled to the first dividing circuit and the error amplifier, for multiplying the comparison result by the first divided voltage to generate a voltage product; and a comparator, coupled to the power switch, the multiplier and the SR flip-flop, for comparing the voltage product and a voltage of the second end of the power switch to generate the reset instruction.

19. The power factor correction device of claim 18, wherein the power switch is a metal oxide semiconductor (MOS) transistor, the first end is a drain, the second end is a source, and the third end is a gate.

20. The power factor correction device of claim 18, wherein the set module comprises:

a sensing inductor, coupled to a ground end, for sensing variation of the inductor current of the intermediate inductor to generate a first trigger instruction;

a timer, coupled to the third end of the power switch and the output end of the SR flip-flop, for generating a second trigger instruction according to variation of the latch result; and a selecting unit, coupled to the sensing inductor, the timer and the set end of the SR flip-flop, for generating the set instruction sent to the set end of the SR flip-flop according to the first trigger instruction or the second trigger instruction.

21. The power factor correction device of claim 20, wherein the sensing inductor generates the first trigger instruction by demagnetization when the inductor current of the intermediate inductor decays to zero.

22. The power factor correction device of claim 20, wherein the timer starts to clock when the inductor current of the intermediate inductor transitions from rising to falling, and then generates the second trigger instruction after a default period.

23. The power factor correction device of claim 22 further comprising a load sensor, coupled to the output module, the set module and the reset module, for sensing a load current of the power factor correction device to generate a sensing result sent to the timer.

24. The power factor correction device of claim 23, wherein the timer shortens the default period when the sensing result indicates that the load current is heavy to reduce a conduction loss of the power factor correction device.

25. The power factor correction device of claim 23, wherein the timer extends the default period when the sensing result indicates that the load current is light to reduce a switching loss of the power factor correction device.

26. The power factor correction device of claim 20, wherein the selecting unit is an OR gate for performing a logic OR operation on the first trigger instruction and the second trigger instruction to generate the set instruction.

27. The power factor correction device of claim 20, wherein the selecting unit is further coupled to the reset module for determining an operation mode of the power factor correction device according to the first trigger instruction or the second trigger instruction to generate a detection result sent to the reset module.

28. The power factor correction device of claim 18 further comprising:

a detector for determining an operation mode of the power factor correction device according to the first trigger instruction and the second trigger instruction to generate a detection result sent to the multiplier of the reset module;

wherein the multiplier is further utilized for compensating a gain according to the detection result to ensure an average of the inductor current remains a full-wave rectified sine wave when the power factor correction device switches the operation mode.

29. The power factor correction device of claim 28, wherein the multiplier switches the gain to a double gain when the detection result indicates that the set instruction is triggered by the first trigger instruction.

30. The power factor correction device of claim 28, wherein the multiplier switches the gain to a unit gain when the detection result indicates that the set instruction is triggered by the second trigger instruction.

31. The power factor correction device of claim 28, wherein the detector is integrated into the set module.

32. The power factor correction device of claim 18, wherein the reset module further comprises a compensation capacitor, comprising one end coupled between the error amplifier and the multiplier and another end coupled to the ground end, for compensating closed-loop frequency response of the power factor correction device and filtering the comparison result.

33. The power factor correction device of claim 18, wherein the output module comprises:

a diode, comprising an anode end coupled to the intermediate inductor and the power switch and a cathode end coupled to the reset module; and an output capacitor, comprising one end coupled to the cathode end of the diode and the reset module and another end coupled to a ground end, for generating the DC output voltage.

34. The power factor correction device of claim 18, wherein the rectifier is a diode bridge rectifier.

* * * * *

UNITED STATES PATENT AND TRADEMARK OFFICE

CERTIFICATE OF CORRECTION

PATENT NO. : 8,525,501 B2
APPLICATION NO. : 12/987999
DATED : September 3, 2013
INVENTOR(S) : Chih-Yuan Hsieh et al.

It is certified that error appears in the above-identified patent and that said Letters Patent is hereby corrected as shown below:

On the title page, item (73), correct the name of the assignee from "NOVATEK Microelectrics Corp." to --NOVATEK Microelectronics Corp.--.

Signed and Sealed this
Fifth Day of November, 2013

Teresa Stanek Rea

Teresa Stanek Rea
*Deputy Director of the United States Patent and Trademark Office*